US007311875B2

(12) United States Patent
Bergkvist et al.

(10) Patent No.: US 7,311,875 B2
(45) **Date of Patent: *Dec. 25, 2007**

(54) HIGH DENSITY STAINLESS STEEL PRODUCTS AND METHOD FOR THE PREPARATION THEREOF

(75) Inventors: Anders Bergkvist, Oslo (NO); Sven Allroth, Höganäs (SE); Paul Skoglund, Höganäs (SE)

(73) Assignee: Höganäs AB, Höganäs (SE)

( * ) Notice: Subject to any disclaimer, the term of this patent is extended or adjusted under 35 U.S.C. 154(b) by 174 days.

This patent is subject to a terminal disclaimer.

(21) Appl. No.: 10/451,996

(22) PCT Filed: Jun. 12, 2002

(86) PCT No.: PCT/SE02/01145

§ 371 (c)(1),
(2), (4) Date: Jun. 27, 2003

(87) PCT Pub. No.: WO02/100581

PCT Pub. Date: Dec. 19, 2002

(65) Prior Publication Data

US 2004/0062674 A1 Apr. 1, 2004

(30) Foreign Application Priority Data

Jun. 13, 2001 (SE) ..... 0102102

(51) Int. Cl.
*B22F 9/00* (2006.01)
*B22F 1/00* (2006.01)

(52) U.S. Cl. ..... 419/38; 75/246

(58) Field of Classification Search ..... 419/38; 75/246

See application file for complete search history.

(56) References Cited

U.S. PATENT DOCUMENTS 3,620,690 A 11/1971 Bergstrom
3,795,509 A * 3/1974 Kinoshita et al. ..... 420/48
4,121,927 A * 10/1978 Lohman et al. ..... 419/14
4,474,732 A * 10/1984 Lynn ..... 419/11
4,601,876 A * 7/1986 Yamashita et al. ..... 419/233
4,724,000 A * 2/1988 Larson et al. ..... 75/236
4,964,908 A * 10/1990 Greetham ..... 75/241
5,002,988 A * 3/1991 Ono et al. ..... 524/1
5,108,492 A 4/1992 Kiyota et al.
5,460,641 A * 10/1995 Aslund et al. ..... 75/255
5,529,604 A * 6/1996 Reinshagen ..... 75/246
5,603,072 A * 2/1997 Kouno et al. ..... 419/25
5,744,433 A 4/1998 Storström et al.
5,936,170 A * 8/1999 Hanlin et al. ..... 75/246
5,976,216 A * 11/1999 Samal et al. ..... 75/255
6,123,748 A * 9/2000 Whitaker et al. ..... 75/252
6,202,757 B1 3/2001 Dahlberg
6,342,087 B1 * 1/2002 Arvidsson et al. ..... 75/255
6,365,095 B1 4/2002 Bergkvist
6,537,489 B2 * 3/2003 Allroth et al. ..... 419/38

FOREIGN PATENT DOCUMENTS

EP 0037446 A1 * 10/1981
EP 0 050 969 5/1982
EP 0 266 935 5/1988
EP 0900856 A1 3/1999
SE 214067 C 7/1967
WO WO 98/58093 12/1998
WO WO 99/36214 7/1999
WO WO99/36214 * 7/1999
WO WO 02/100581 A1 * 12/2002

* cited by examiner

*Primary Examiner*—Susy Tsang-Foster
*Assistant Examiner*—Nicholas A. Smith
(74) *Attorney, Agent, or Firm*—Buchanan Ingersoll & Rooney PC

(57) ABSTRACT

The invention concerns a method of preparing products having a sintered density of above 7.3 g/cm$^3$. This method comprises the steps of subjecting a water-atomised, stainless steel powder to HVC compaction with an uniaxial pressure movement with a ram speed of at least 2 m/s, and sintering the green body.

21 Claims, No Drawings

HIGH DENSITY STAINLESS STEEL PRODUCTS AND METHOD FOR THE PREPARATION THEREOF

FIELD OF THE INVENTION

This invention relates to the general field of powder metallurgy. Particularly the invention is concerned with high-density stainless steel products and a compacting and sintering operation for achieving such products.

BACKGROUND OF THE INVENTION

Currently used methods for preparing high density products, such as flanges, of stainless steel powders involve compacting the stainless steel powders to densities of between about 6.4 and 6.8 g/cm$^3$ at compaction pressures of 600-800 MPa. The obtained green body is then sintered at high temperatures, i.e. temperatures up to 1400° C. for 30 to 120 minutes in order to get densities of about 7.25 g/cm$^3$. The requirement for the long sintering times at the comparatively high temperatures is of course a problem considering the high energy costs. The necessity for special, high temperature furnaces is another problem.

A recently developed method of achieving high sintered densities in sintered stainless steel parts is disclosed in the WO patent publication 99/36214. According to this method a gas atomised metal powder having spherical particles is agglomerated with at least 0.5% by weight of a thermoreversible hydrocolloid as a binder. The agglomerated composition is then compacted in a uniaxial press operation with a ram speed of over 2/s to a green body having a high density. When the metal powder is a stainless steel powder the publication recommends sintering at 1350° C. for 2 to 3 hours in order get high sintered densities.

OBJECTS OF THE INVENTION

An object of the invention is to provide a solution to these problems and provide a method for the preparation of high-density products, particularly products having a sintered density above 7.25, preferably above 7.30 and most preferably above 7.35 g/cm$^3$.

A second object is to provide a compaction method adapted to industrial use for mass production of such high-density products.

A third object is to provide a process for the sintering of such compacted products requiring less energy.

A fourth object is to provide a process for sintering the stainless steel compacts to densities above about 7.25 g/cm$^3$ which can be performed in conventional furnaces without need for special high temperature equipment.

A fifth object is to provide a process for the manufacturing of large sintered stainless steel PM products, such as flanges, having a relatively simple geometry.

A sixth object is to provide a process for the manufacturing of sintered stainless steel PM products, without the use of a separate step for agglomeration with a thermoreversible hydrocolloid.

SUMMARY OF THE INVENTION

In brief the method of preparing such high density products comprises the steps of subjecting a water-atomised stainless steel to compaction with a uniaxial pressure movement at an impact ram speed above 2 m/s; and sintering the green body.

DETAILED DESCRIPTION OF THE INVENTION

The powders subjected to compaction are water-atomised stainless steel powders which, in addition to iron, include, by percent of weight, 10-30% of chromium. The stainless steel powder may optionally also be pre-alloyed with other elements such as, nickel, manganese, niobium, titanium, vanadium. The amounts of these elements may be 0-5% of molybdenum, 0-22% of nickel, 0-1.5% of manganese, 0-2% of niobium, 0-2% of titanium, 0-2,% of vanadium. Normally at most 0.3% of inevitable impurities are present. Most preferably the amounts of the pre-alloyed elements are 10-20% of chromium, 0-3% of molybdenum, 0.1-0.4% of manganese, 0-0.5% of niobium, 0-0.5% of titanium, 0-0.5% of vanadium, and essentially no nickel or alternatively 5-15% of nickel. Examples of water-atomised stainless steel powders which are suitably used according to the present invention are 316 LHC, 316 LHD, 409 Nb, 410 LHC, 434 LHC. According to the present invention standard steel powders which generally include more than 0.5% by weight of Si are preferred. Normally the Si content of such standard powders vary between 0.7 and 1% by weight.

The stainless steel powders used according to the invention are produced by water atomisation and are thus distinguished by particles having an irregular form in contrast to powders prepared by gas atomisation which ere distinguished by spherical particles.

However, also annealed low carbon, low oxygen stainless steel powder may be used. Such powders include, in addition to chromium and optional other elements mentioned above, not more than 0.4%, preferably not more than 0.3% by weight of oxygen, not more than 0.05%, preferably not more than 0.02% and most preferably not more than 0.015% of carbon, at most 0.5% by weight of Si and not more than 0.5% of impurities. Such powders and the preparation thereof are described in the U.S. Pat. No. 6,342,087 which is hereby incorporated by reference.

In order to obtain the products having the desired high density according to the present invention the compacting method is important. Normally used compaction equipment does not work quite satisfactorily, as the strain on the equipment will be too great. It has now been found that the high densities required may be obtained by the use of the computer controlled percussion machine disclosed in the U.S. Pat. No. 6,202,757 which is which is hereby incorporated by reference. Particularly, the impact ram of such a percussion machine may be used for impacting the upper punch of a die including the powder in a cavity having a shape corresponding to the desired shape of the final compacted component. When supplemented with a system for holding a die, e.g. a conventionally used die, and a unit for powder filling (which may also be of conventional type) this percussion machine permits an industrially useful method for production of high-density compacts. An especially important advantage is that, in contrast to previously proposed methods, this arrangement driven by hydraulics permits mass production (continuous production) of such high density components.

In the U.S. Pat. No. 6,202,757 it is stated that the use of the percussion machine involves "adiabatic" moulding. As it is not fully clarified if the compaction is adiabatic in a strictly scientific meaning we have used the term high velocity compaction (HVC) for this type of compaction wherein the density of the compacted product is controlled by the impact energy transferred to the powder.

According to the present invention the ram speed should be above 2 m/s. The ram speed is a manner of providing energy to the powder through the punch of the die. No straight equivalence exists between compaction pressure in a conventional press and the ram speed. The compaction which is obtained with this computer controlled HVC depends, in addition to the impact ram speed, i.a. on the amount of powder to be compacted, the weight of the impact body, the number of impacts or strokes, the impact length and the final geometry of the component. Furthermore, large amounts of powder require more impacts than small amounts of powder. Thus the optimal conditions for the HVC compaction i.e. the amount of kinetic energy which should be transferred to the powder, may be decided by experiments performed by the man skilled in the art. Contrary to the teaching in the U.S. Pat. No. 6,202,757 there is, however, no need to use a specific impact sequence involving a light stroke, a high energy stroke and a medium-high energy stroke for the compaction of the powder. Experiments with existing equipment has permitted ram speeds up to 30 m/s and, as is illustrated by the examples, high green densities are obtained with ram speeds about 10 m/s. The method according to the invention is however not restricted to these ram speeds but it is believed that ram speeds up to 100 or even up to 200 or 250 m/s may be used. Ram speeds below about 2 m/s does, however, not give the pronounced effect of densification.

The compaction may be performed with a lubricated die. It is also possible to include a suitable lubricant in the powder to be compacted. Alternatively, a combination thereof may be used. It is also possible to use powder particles provided with a coating. This coating or film is achieved by mixing the powder composition, which includes the free or loose, non agglomerated powder particles with the lubricant, subjecting the mixture to an elevated temperature for melting the lubricant and subsequently cooling the obtained mixture during mixing for solidifying the lubricant and thereby providing the powder particles or aggregates thereof with a lubricant film or coating.

The lubricant can be selected among conventionally used lubricants such as metal soaps, waxes and thermoplastic materials, such as polyamides, polyimides, polyolefins, polyesters, polyalkoxides, polyalcohols. Specific examples of lubricants are zinc stearate, lithium stearate, H-wax® and Kenolube®.

The amount of lubricant used for internal lubrication i.e. when the powder before compaction is fixed with a lubricant, generally varies between 0.1-2 preferably between 0.6 and 1.2% by weight of the composition.

The subsequent sintering may be performed at a temperature between about 1120 and 1250° C. for a period between about 30 and 120 minutes. According to a preferred embodiment the sintering is performed in a belt furnace at temperatures below 1180° C., preferably below 1160° C. and most preferably below 1150° C. This is particularly the case for the annealed stainless steel powders mentioned above. When such annealed powders are used it is a particular advantage of the invention that the compacts having near theoretical density may be sintered at low temperatures, such is 1120-1150° C., in conventional furnaces, such as belt furnaces. This is in contrast to conventional compaction methods where it is not possible to obtain such high green densities and where a high sintered density is obtained by high temperature sintering, which causes shrinkage of the compacts. By using the HVC compaction method with no or a very small amount of lubricant included in the powder composition to be compacted, the green density will be essentially identical with the sintered density. This in turn means that very good tolerances are obtained.

The invention is however not restricted to sintering at such low temperatures and by sintering at higher temperatures, such as up to 1400° C. even higher densities may be obtained. When standard stainless steel powders are used according to the present invention sintering temperatures between 1200 and 1280° C. seem to be the most promising alternative.

It is also preferred that the sintering is performed in vacuum or in a reducing or inert atmosphere. Most preferably the sintering is performed in a hydrogen atmosphere. The sintering time is generally less than an hour.

The method according to the invention permits the manufacture of green and sintered compacts having high density, such as above 7.25, 7.30 and even 7.35 g/cm$^3$. The method also may permit high elongation. For e.g. stainless steel 316 an elongation above 30% may be obtained.

The invention as described in the present specification and the appended claims is believed to be of especial importance for large scale production of large sintered stainless steel PM compacts having a comparatively simple geometry, where high sintered density is required and where high ductility is important. An example of such products is flanges. Other products which may be of interest are gas-tight oxygen probes. The invention is, however, not limited to such products.

The invention is further illustrated by the following example:

EXAMPLE 1

The powders having the compositions given in the following table 1 were subjected to HVC compaction using a compaction machine Model HYP 35-4 from Hydropulsor AB, Sweden.

TABLE 1

| | % Cr | % Ni | % Si | % Mn | % Mo | % Nb | % C | % O | % Fe |
|---|---|---|---|---|---|---|---|---|---|
| 434 LHC | 16.9 | 0.1 | 0.76 | 0.16 | 1.0 | 0 | 0.016 | 0.22 | Bal |
| 409 Nb | 11.3 | 0.1 | 1.0 | 0.1 | 0.0 | 0.5 | 0.01 | 0.15 | Bal |
| 316 LHD | 16.9 | 12.8 | 0.8 | 0.1 | 2.3 | 0 | 0.02 | 0.36 | Bal |
| 410 LHC | 11.8 | 0.2 | 0.8 | 0.1 | 0.0 | 0 | <0.01 | 0.24 | Bal |
| 316 LHC | 17.3 | 12.6 | 0.9 | 0.1 | 2.3 | 0 | 0.01 | 0.28 | Bal |
| 409 Nb* | 11.6 | 0.1 | 0.1 | 0.1 | 0.0 | 0.5 | 0.01 | 0.08 | Bal |

*annealed according to the method disclosed in the U.S. Pat. No. 6342087

The base powders were mixed with a lubricant powder the amounts listed in the following table. The lubricants used were Kenolube™ and Acrawax™. The samples 1-6 included 0.1% by weight of Li stearate.

TABLE 2

| Sample | Base powder | Lubricant amount % by weight | Lubricant |
|---|---|---|---|
| 0 | 316 LHC | 0.9 | Kenolube |
| 1 | 316 LHC | 0.9 | Acrawax |
| 2 | 316 LHD | 0.9 | Acrawax |

TABLE 2-continued

| Sample | Base powder | Lubricant amount % by weight | Lubricant |
|---|---|---|---|
| 3 | 409 Nb annealed | 0.8 | Acrawax |
| 4 | 409 Nb | 0.8 | Acrawax |
| 5 | 409 Nb | 0.8 | Acrawax |
| 6 | 316 LHC | 0.9 | Kenolube |

The following table 3 discloses green densities and sintered densities obtained with the HVC compaction method. As can be seen, the densities obtained when the sintering was performed at 1250° C. for 45 minutes in dry hydrogen, are above 7.5 g/cm for all but two samples. This table also shows the impact of the stroke length and the number of strokes on the density.

TABLE 3

| Sample | Stroke length (mm) | Green density ($g/cm^3$) | Sintered density 1250° C. |
|---|---|---|---|
| 0 | 20 + 30 | 7.23 | 7.47 |
| 1 | 20 + 30 | 7.25 | 7.52 |
| 2 | 20 + 35 | 7.25 | 7.55 |
| 3 | 20 + 30 | 7.24 | 7.51 |
| 4 | 20 + 35 | 7.12 | 7.53 |
| 5 | 20 + 30 | 7.12 | 7.51 |
| 6 | 20 + 30 | 7.23 | 7.48 |

The following table 4 discloses the results obtained when the samples were compacted with a conventional compaction equipment at a compaction pressure of 800 MPa and sintered at 1300° C. and 1325° C. respectively. As can be seen sintered densities above 7.5 $g/cm^3$ could be obtained only when the sintering was performed at 1325° C. and for only two of the samples. The sintering was performed in hydrogen atmosphere for 60 minutes.

TABLE 4

| Sample | Compaction pressure MPa | GD ($g/cm^3$) | SD ($g/cm^3$) 1300° C. | SD ($g/cm^3$) 1325° C. |
|---|---|---|---|---|
| 1 | 800 | 6.90 | 7.32 | 7.35 |
| 2 | 800 | 6.84 | 7.30 | 7.33 |
| 3 | 800 | 7.00 | 7.41 | 7.46 |
| 4 | 800 | 6.68 | 7.47 | 7.54 |
| 5 | 800 | 6.72 | 7.46 | 7.51 |

EXAMPLE 2

This example demonstrates the results obtained with two types of stainless steel powders having the composition disclosed in table 1. The lubricant method was of the type generally referred to as die wall lubrication and involved lubrication of the die with zinc stearate dissolved in acetone. After drying 70 g of the powder was poured into the die. The powder samples are designated A and B, respectively, as in the following table 5 and the green and sintered densities are reported in table 6. The sintering time and atmosphere was the same as in example 1.

TABLE 5

| Sample | Base powder | Lubricant method |
|---|---|---|
| A | 409 Nb | DWL |
| B | 409 Nb annealed | DWL |

TABLE 6

| Sample | Stroke length (mm) | GD ($g/cm^3$) | SD ($g/cm^3$) 1150° C. |
|---|---|---|---|
| A | 10 | 5.50 | |
| A | 20 | 6.06 | 6.04 |
| A | 30 | 6.41 | |
| A | 40 | 6.67 | 6.66 |
| A | 50 | 6.91 | |
| A | 60 | 7.12 | 7.10 |
| A | 65 | 7.15 | |
| A | 70 | 7.21 | 7.19 |
| B | 10 | 5.86 | |
| B | 20 | 6.44 | 6.42 |
| B | 30 | 6.81 | |
| B | 40 | 7.10 | 7.06 |
| B | 50 | 7.27 | |
| B | 55 | 7.35 | 7.32 |
| B | 60 | 7.41 | |
| B | 65 | 7.41 | 7.39 |

Table 6 shows the impact of the stroke length on the density. The stroke lengths, which varied between 10 and 70 mm, correspond to ran speeds between about 3 and about 8 m/s. As can be seen from table 6 sintered densities above 7.3 $g/cm^3$ can be obtained by using an annealed powder. The table also discloses that very low dimensional change can be obtained.

The following table 7 summarises some of the important features of the invention in comparison with a conventional method where the compaction is performed in a conventional die at a compaction pressure of 800 MPa. As can be seen the method according to the present invention makes it possible to obtain higher sintered densities in spite of the fact that the sintering has been performed at a lower temperature. Additionally the lower dimensional change is an indication that better tolerances will be obtained.

TABLE 7

| Powder | Pressure (MPa) Stroke length (mm) | GD ($g/cm^3$) | Sint. temp (° C.) | Dim. change (%) | SD ($g/cm^3$) | Elongation (%) |
|---|---|---|---|---|---|---|
| 316 LHC | 800 | 6.90 | 1300 | −2.9 | 7.32 | >30 |
| 316 LHC* | 20 + 30 | 7.25 | 1250 | −1.2 | 7.52 | >30 |
| 409 Nb | 800 | 6.68 | 1300 | −4.0 | 7.47 | 12 |
| 409 Nb* | 20 + 35 | 7.12 | 1250 | −2.0 | 7.53 | 13 |
| 409 Nb ann. | 800 | 7.00 | 1300 | −2.4 | 7.41 | 16 |
| 409 Nb* ann. | 20 + 30 | 7.24 | 1250 | −1.3 | 7.51 | 16 |

*According to the present invention

The invention claimed is:

1. Method of preparing compacts having a high density, comprising the steps of:

subjecting a water atomized, stainless steel powder composition to high velocity compaction (HVC) with a uniaxial pressure movement with an impact ram speed above 2 m/s to produce a green body, which powder, in addition to iron, comprises at least 10% by weight of chromium, wherein the particles of the powder have an irregular form and the powder composition also comprises a lubricant selected from the group consisting of metal soaps, waxes, polyamides, polyimides, polyolefins, polyesters, polyalkoxides, and polyalcohols, and sintering the green body.

2. Method according to claim 1 wherein the powder is non-aggregated.

3. Method according to claim 1 wherein the stainless steel powder is a standard stainless steel powder, which has not been annealed.

4. Method according to claim 1 wherein the stainless steel powder is an annealed stainless steel powder.

5. Method according to claim 1 wherein the compaction is performed with a lubricated die.

6. Method according to claim 3 wherein the sintering is performed at a temperature between about 1200° C. and 1300° C. for a period between about 30 minutes and 120 minutes.

7. Method according to claim 4 wherein the sintering is performed in a continuous furnace at temperatures below 1250° C. for a period between about 30 minutes and 120 minutes.

8. Method according to claim 6 wherein the sintering is performed in vacuum or in a reducing or inert atmosphere.

9. Method according to claim 1 wherein the powder composition is compacted to a green density of at least 7.2 g/cm$^3$ and sintered to a density of at least 7.3 g/cm$^3$.

10. Method according to claim 1 wherein the compaction is performed with a lubricated die and a minor amount of said lubricant is admixed with the powder composition.

11. Method according to claim 3 wherein the sintering is performed at a temperature between 1200° C. and 1300° C. for a period between about 30 minutes and less than 60 minutes.

12. Method according to claim 4 wherein the sintering is performed in a continuous furnace at temperatures below 1200° C. for a period between about 30 minutes to less than 60 minutes.

13. Method according to claim 4 wherein the sintering is performed in a continuous furnace at temperatures below 1160° C. for a period between about 30 minutes to less than 60 minutes.

14. Method according to claim 7 wherein the sintering is performed in vacuum or in a reducing or inert atmosphere.

15. Method according to claim 6 wherein the sintering is performed in a hydrogen atmosphere.

16. Method according to claim 7 wherein the sintering is performed in a hydrogen atmosphere.

17. Method according to claim 1 wherein the powder composition is compacted to a green density of at least 7.2 g/cm$^3$ and sintered to a density of at least 7.4 g/cm$^3$.

18. Method according to claim 1 wherein the powder is non-aggregated, and the green body is sintered at a temperature of less than 1200° C.

19. Method according to claim 1 wherein said lubricant is present with said water atomized stainless steel powder having an irregular form in a concentration of 0.1 to 2% by weight of the powder composition.

20. Method according to claim 1 wherein said lubricant is present with said water atomized stainless steel powder having an irregular form in a concentration of 0.6 to 1.2% by weight of the powder composition.

21. Method of preparing compacts having a high density, comprising:

subjecting a water atomized, stainless steel powder composition to high velocity compaction (HVC) with a uniaxial pressure movement with an impact ram speed above 2 m/s to produce a green body, wherein the powder, in addition to iron, comprises at least 10% by weight of chromium and the particles of the powder have an irregular form, and the powder composition also comprises a lubricant selected from the group consisting of metal soaps, waxes, polyamides, polyimides, polyolefins, polyesters, polyalkoxides and polyalcohols; and sintering the green body at a sintering temperature below 1250° C.

wherein the sintered body has a density of at least 7.2 g/cm$^3$.

* * * * *